US006792855B2

(12) United States Patent
Pertile

(10) Patent No.: US 6,792,855 B2
(45) Date of Patent: Sep. 21, 2004

(54) FLEXOGRAPHIC MACHINE

(75) Inventor: Agostino Renato Pertile, San Martino Buon Albergo (IT)

(73) Assignee: Uteco Holding S.p.A, Colognola Ai Colli (IT)

( * ) Notice: Subject to any disclaimer, the term of this patent is extended or adjusted under 35 U.S.C. 154(b) by 7 days.

(21) Appl. No.: 10/637,674

(22) Filed: Aug. 11, 2003

(65) Prior Publication Data

US 2004/0045463 A1 Mar. 11, 2004

(30) Foreign Application Priority Data

Sep. 9, 2002 (IT) ..... VR2002A000088

(51) Int. Cl.[7] ..... B41F 31/00
(52) U.S. Cl. ..... 101/350.6; 101/169; 15/236.06
(58) Field of Search ..... 101/169, 350.6, 101/367; 15/236.05, 236.06; 102/272, 281

(56) References Cited

U.S. PATENT DOCUMENTS 3,521,561 A 7/1970 Bryer et al.
3,611,471 A * 10/1971 Meskanen et al. ..... 15/256.51
4,397,238 A * 8/1983 Westerkamp ..... 101/367
5,671,673 A 9/1997 Boose et al.
6,276,270 B1 * 8/2001 Leanna ..... 101/350.6
6,521,092 B2 * 2/2003 Isometsä ..... 162/272
6,544,388 B2 * 4/2003 Dennis, Jr. ..... 15/256.53
6,637,330 B1 * 10/2003 Nordby et al. ..... 101/350.6

FOREIGN PATENT DOCUMENTS

EP 0 499 382 8/1992
EP 0 607 574 7/1994

* cited by examiner

*Primary Examiner*—Eugene H. Eickholt
(74) *Attorney, Agent, or Firm*—Guido Modiano; Albert Josif; Daniel O'Byrne

(57) ABSTRACT

A flexographic machine comprising at least one inking unit that has lateral supporting means for a doctor body that forms at least partially an inking chamber and supports at least one first doctor blade and at least one second doctor blade; the inking unit further comprises elements for contrasting the inflection of the doctor body that occurs when the inking unit is in the active condition; the elements that contrast the inflection of the doctor body comprise elements adapted to apply a contrasting flexural action to the doctor body, at least when the inking unit is in the active condition; the contrasting flexural action is substantially equal and opposite to the flexural action affecting the doctor body when the inking unit is in the active condition.

10 Claims, 5 Drawing Sheets

FLEXOGRAPHIC MACHINE

BACKGROUND OF THE INVENTION

The present invention relates to a flexographic machine.

It is known that in conventional flexographic machines there are printing units formed by a first cylinder, which supports a printing plate designed to apply ink to the material to be printed, by a central drum, on which the material to be printed rests, by an anilox roller, which is responsible for inking the printing plate, and by an inking unit, which in turn is designed to wet the anilox roller with ink.

The surface of the anilox roller is provided with etched microcells (hence the term anilox), which are designed to be filled uniformly by the inking unit.

Generally speaking, the inking unit has a doctor body, which is supported laterally by sliders that can move on guides supported by the two lateral shoulders of the flexographic machine.

Two doctor blades are mounted on the doctor body and are placed in contact with the surface of the anilox roller during its inking, in order to remove the excess ink and achieve uniform distribution of the ink on the anilox roller.

In particular, the doctor body delimits, together with the doctor blades, two lateral sealing gaskets and the sector of the anilox roller that is affected by the doctor blades, an inking chamber into which the ink is sent at a pressure that depends on its viscosity.

The frequent operations for cleaning the doctor body and replacing worn blades generally require removing and subsequently assembling the doctor body with respect to the flexographic machine.

Since these operations are performed manually by the operator, the weight of the doctor body must be limited.

Accordingly, such body is usually made of lightweight material, such as aluminum or other light alloys.

However, its limited weight limits the flexural rigidity of the doctor body, although such rigidity is decisive for the correct inking of the anilox roller.

In order to achieve correct inking of the anilox roller, it is critical that the contact pressure between the doctor blades and the surface of the anilox roller, known as doctor pressure, be constant over time and uniform over the entire length of said anilox roller.

For this reason, the inking unit is provided with devices, generally constituted by linear actuators that usually act by means of the lateral supports of the doctor body, which are designed to apply and control doctor pressure.

The pressure of the ink inside the inking chamber and the force applied to the doctor body in order to ensure that contact is maintained between the doctor blades and the anilox roller tend to generate an inflection of the doctor body due to its reduced flexural rigidity.

Such inflection causes a separation of the central portion of the doctor blades from the surface of the anilox roller or in any case a reduction of the doctor pressure, with a consequent degradation of the inking conditions and the consequent onset of uneven wear of the doctor blades.

The extent of the inflection affecting the doctor body during inking of the anilox roller of course also depends on its length and therefore on the overall width of the flexographic machine.

In order to try to solve the problems linked to the inflection of the doctor body, inking units have already been devised which are provided with a doctor body having stiffening ridges designed to increase its flexural rigidity or is optionally provided with a resisting cross-section that has a high moment of inertia.

These technical solutions have not proved to be fully adequate, since the possibility to act on the flexural rigidity of the doctor body is greatly limited by its above mentioned low weight requirements.

Another proposed solution uses a doctor body being supported by a beam that has, in its central part, a protrusion that is designed to bend the doctor body in the inactive condition in order to compensate for the inflection that affects it in operating conditions.

Although this embodiment is valid from a conceptual standpoint, it has proved to be scarcely practical both from the functional and from the production standpoints.

First of all, it is in fact capable of ensuring a sufficient compensation of the deformation affecting the doctor body only in very specific operating conditions and not in all conditions.

Secondly, the beam, in addition to being complicated to manufacture, is particularly bulky, and therefore limits the possibility to clean the anilox roller, makes it awkward to remove the ink collection tray located below the inking unit, and finally forces to locate the points where the ink enters and exits from the inking chamber in specific positions that are not affected by the beam and by the system for fixing said beam to the doctor body.

SUMMARY OF THE INVENTION

The aim of the present invention is to provide a flexographic machine that is capable of providing a valid solution to the technical problem cited above and is capable of eliminating the drawbacks noted above.

Within this aim, an object of the present invention is to provide a flexographic machine that has a doctor body provided with such a flexural rigidity that it can withstand adequately the flexural stresses that affect it in any operating condition, yet at the same time has a limited weight so as to allow its manual handling by operators.

Another object of the invention is to provide a flexographic machine that allows to replace the doctor blades rapidly and without the aid of tools for the operator.

A further object is to provide a flexographic machine that has an inking unit whose structure is very simple, highly durable, simple to manage and competitive in terms of manufacturing cost.

This aim and these and other objects that will become better apparent hereinafter are achieved by a flexographic machine according to the invention, which comprises at least one inking unit that has lateral supporting means for a doctor body that forms at least partially an inking chamber and supports at least one first doctor blade and at least one second doctor blade, said at least one inking unit comprising means for the advancement/retraction of said doctor body that are adapted to move it from a retracted position to a forward position, in which said at least one first doctor blade and said at least one second doctor blade engage an anilox roller in order to ink said anilox roller, said at least one inking unit further comprising means for feeding the ink to said inking chamber and means that contrast the inflection of said doctor body that occurs when said inking unit is in the active condition, and is characterized in that said means that contrast the inflection of said doctor body comprise means that are adapted to apply a contrasting flexural action to said doctor body, at least when said inking unit is in the active condition, said contrasting flexural action being substantially equal and opposite to the flexural action induced on said doctor body when said inking unit is in the active condition.

Advantageously, such means adapted to apply a contrasting flexural action comprise bending means that are adapted to bend said doctor body and means for adjusting the bending of said doctor body.

BRIEF DESCRIPTION OF THE DRAWINGS

Further characteristics and advantages of the invention will become better apparent from the description of a preferred but not exclusive embodiment of a flexographic machine according to the invention, illustrated by way of non-limitative example in the accompanying drawings, wherein.

Figure 1:
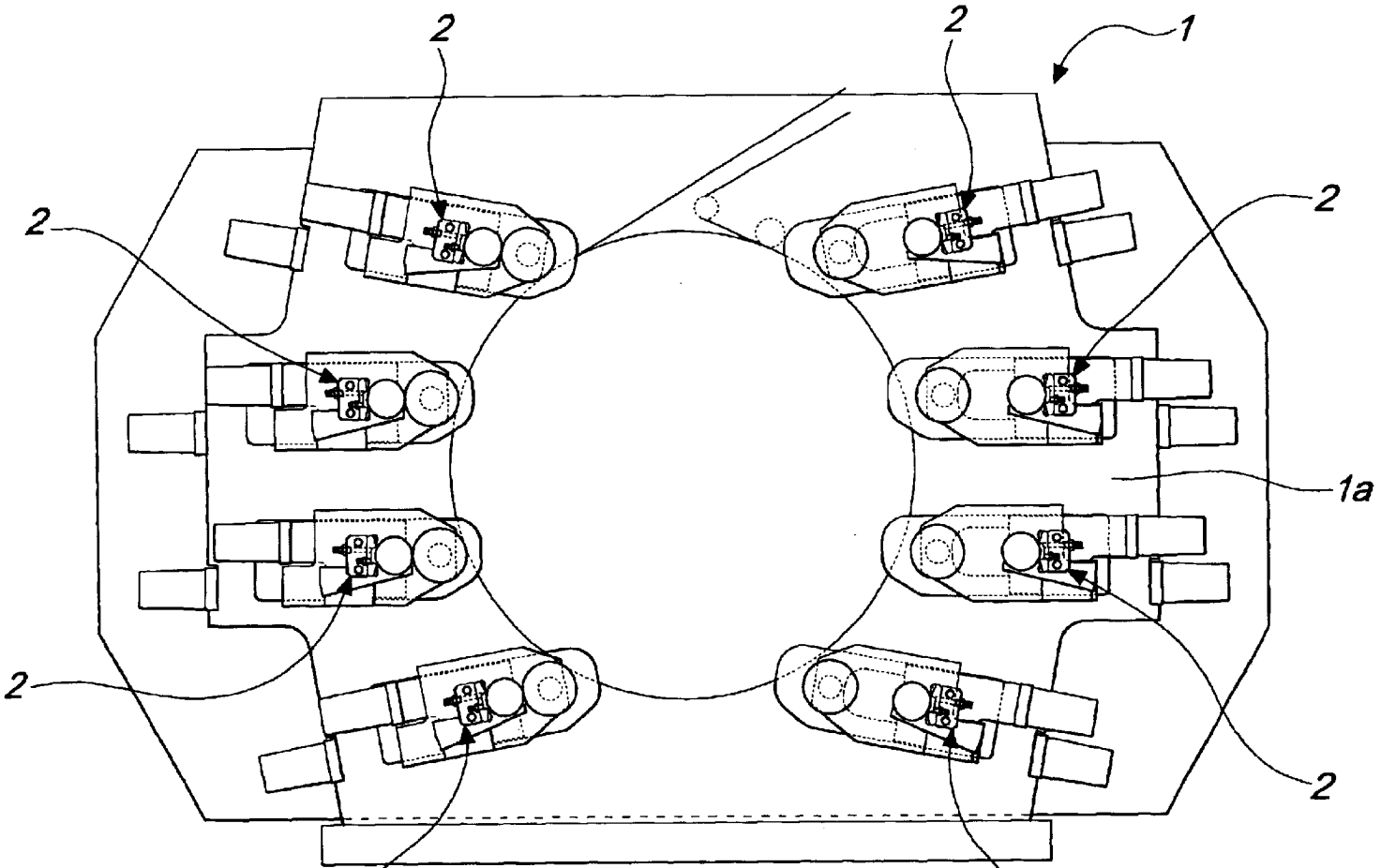
FIG. 1 is a schematic side elevation view of a flexographic machine according to the invention.
Figure 2:
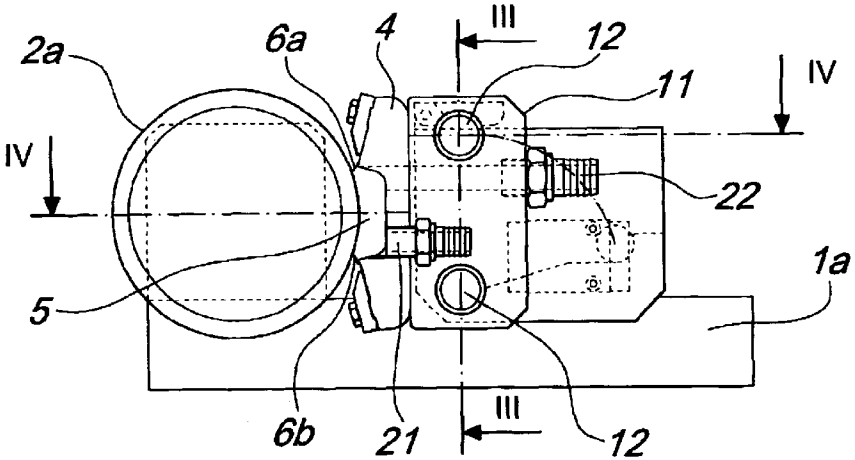
FIG. 2 is a side view of an anilox roller and of a doctor body in the active condition.

In the examples of embodiment that follow, individual characteristics, given in relation to specific examples, may actually be interchanged with other different characteristics that exist in other examples of embodiment.

DESCRIPTION OF THE PREFERRED EMBODIMENTS

With reference to the figures, a flexographic machine according to the invention, generally designated by the reference numeral 1, comprises at least one inking unit 2, which has lateral supporting means 3 for a doctor body 4, which is preferably constituted by an extruded element made of aluminum.

The lateral supporting means 3 are constituted by a first lateral slider 3*a* and by a second lateral slider 3*b*, which are arranged so that they can slide on respective guides 3*c*, each of which is formed on a respective lateral shoulder 1*a* of the flexographic machine 1.

The doctor body 4 forms at least one part of an inking chamber 5 and supports at least one first doctor blade 6*a* and at least one second doctor blade 6*b*.

The inking unit 2 is provided with means 7 for the advancement/retraction of the doctor body 4, which are designed to move it from a retracted position, in which it is parked when the flexographic machine 1 is inactive, to an advanced position, in which the first and second doctor blades 6*a* and 6*b* engage an anilox roller 2*a* in order to ink it.

Advantageously, the advancement/retraction means 7 have a first linear actuator 7*a* and a second linear actuator 7*b*, which act respectively on the first lateral slider 3*a* and on the second lateral slider 3*b*, so as to apply their action to both ends of the doctor body 4.

The first linear actuator 7*a* and said second linear actuator 7*b* are constituted for example by pneumatic cylinders which are provided with a pneumatic pressure regulator, which allows to set the force they apply in order to obtain the intended doctor pressure.

The inking unit 2 is further provided with means that contrast the inflection undergone by the doctor body 4 when the inking unit is in the active condition.

According to the invention, such means that contrast the inflection of the doctor body 4 are provided with means that are suitable to apply to the doctor body 4 a contrasting flexural action that is substantially equal and opposite to the flexural action affecting the doctor body 4 when the inking unit 2 is in the active condition.

Also according to the invention, such means adapted to apply to the doctor body 4 a contrasting flexural action are active at least when the inking unit is in the active condition and advantageously have bending means 8, which are designed to apply a flexural force to the doctor body 4 so as to bend it, and means 9 for adjusting the bending of the doctor body 4 actuated by said bending means 8.

Conveniently, the adjustment means 9 are structured so as to allow to vary adjustably the bending of the doctor body 4 both substantially according to its length and according to the operating conditions of the inking unit 2 and accordingly also of the doctor body 4.

In greater detail, the bending means 8 are arranged, with respect to the doctor body, on the opposite side with respect to the side directed toward the anilox roller 2*a*, in order to allow to apply a bending action that is opposite with respect to the one affecting the doctor body 4 during the inking of the anilox roller 2.

Advantageously, the bending means 8 are provided with at least one stiffening traction element 10, which due to reasons linked to the low weight requirements of the inking unit preferably has an elongated tubular body.

Figure 3:
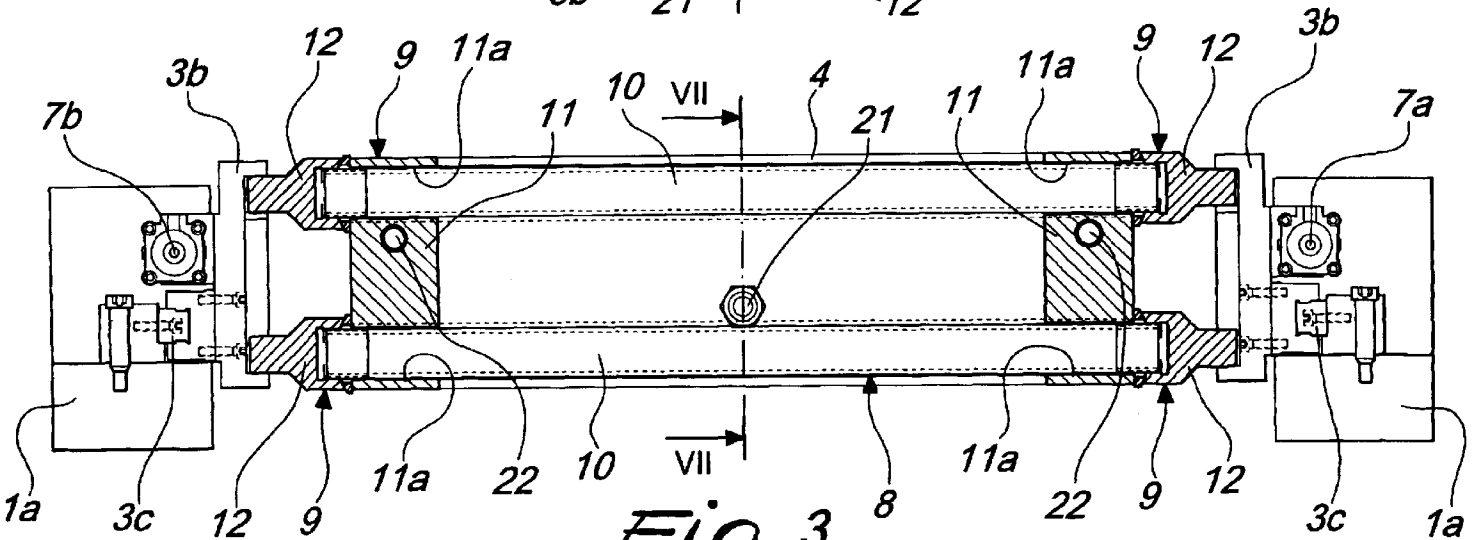
FIG. 3 is a sectional view, taken along the line III—III of FIG. 2.
Figure 4:
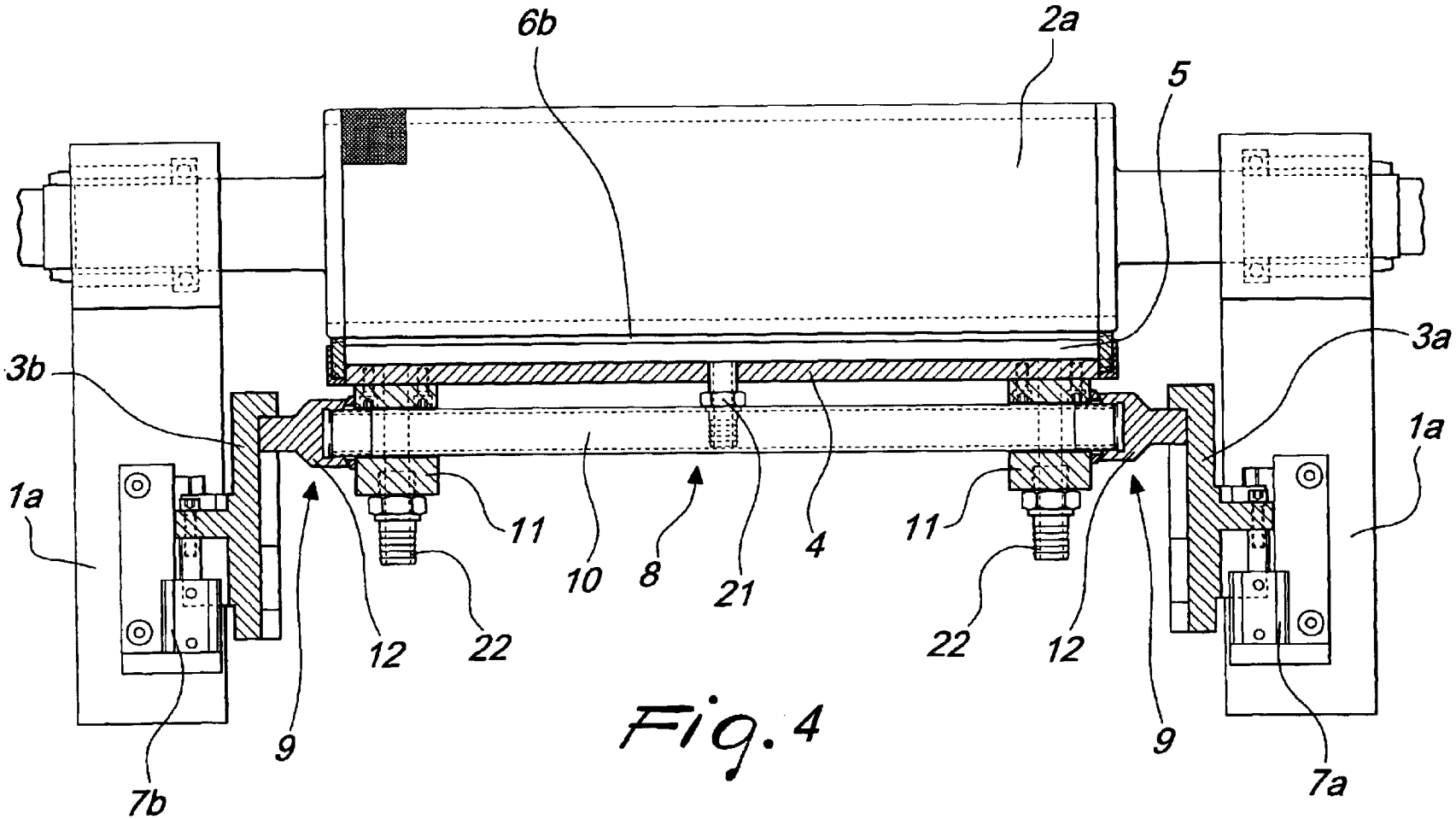
FIG. 4 is a schematic top view of an anilox roller and a sectional view, taken along the line IV—IV, of the doctor body in the active condition.

With reference to FIGS. 3 and 4, it can be seen that each one of the stiffening traction elements 10 is arranged so as to act between a pair of spacing supports 11.

Each one of the spacing supports 11 is constituted for example by a block-like element and is connected mechanically, by way of suitable fixing means such as screws and/or pins or other suitable coupling means, to the doctor body 4, at a respective substantially terminal portion of the doctor body 4.

According to a possible embodiment, the spacing supports 11 can be provided with through seats 11*a* for the terminal portions of the stiffening traction elements 10.

Advantageously, the adjustment means 9 are constituted by at least one adjustment sleeve 12, which is provided with a thread to allow its engagement by screwing with a respective end of the stiffening traction elements 10 that is provided with a suitable complementary thread.

In particular, the end of the stiffening traction elements 10, provided with a complementary thread and designed to engage the sleeve 12, is arranged so that it protrudes from the through seat 11*a* formed on the spacing support 11 that lies closest thereto.

As shown in particular by FIG. 4, both ends of the stiffening traction elements 10 can protrude from the spacing supports 11 and can be engaged by screwing with a respective adjustment sleeve 12.

As an alternative, only one of the ends of the stiffening traction elements 10 can be engaged with a respective adjustment sleeve 12 and the other end can be anchored rigidly to the corresponding spacing support 11 by way of fixing means of any kind.

By screwing the adjustment sleeves 12 onto the respective ends of the stiffening traction elements 10, they are made to abut against the spacing support 11, from which the respective ends protrude.

By doing so, a traction force is generated on the stiffening traction elements 10; such force, by acting in turn on the spacing supports 11, generates through the supports a constant flexural moment along the doctor body 4.

Figure 5:
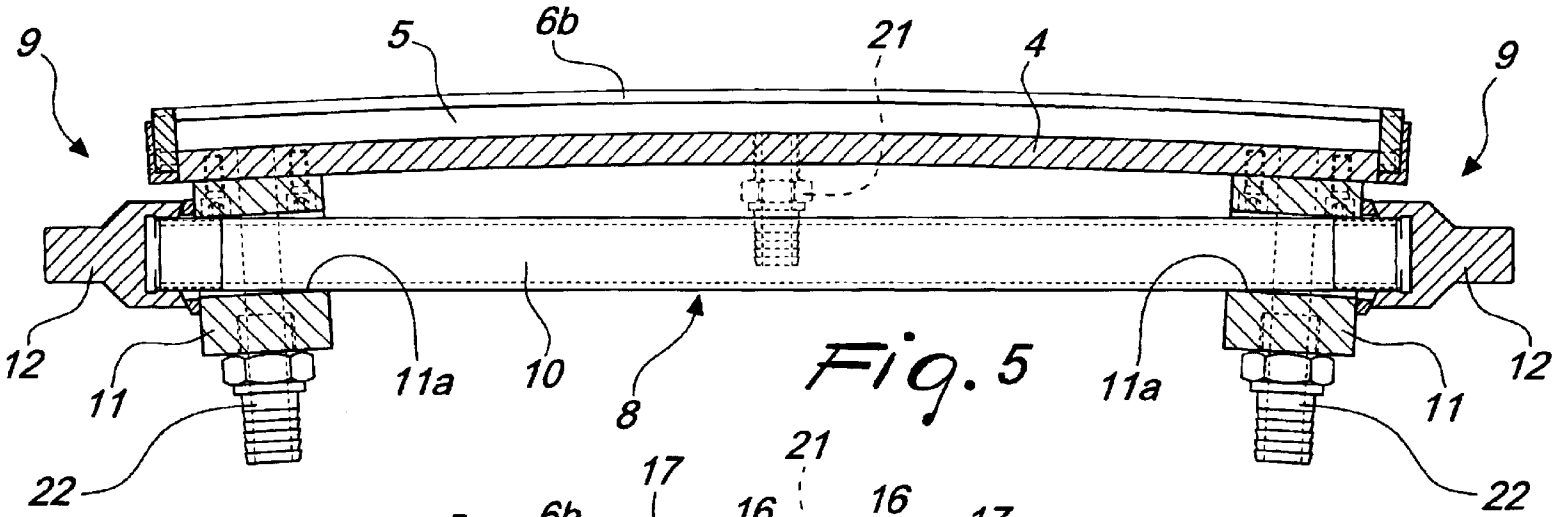
FIG. 5 is a sectional view of the doctor body, similar to the view of FIG. 4, illustrating the effect of the intervention of means suitable to apply a contrasting flexural action to the doctor body.

In inactive conditions, the doctor body 4 assumes, under the action of the constant flexural moment, an arc-like configuration, as shown for example in FIG. 5.

More particularly, by adjusting the screwing of the sleeve 12 it is possible to actuate the doctor body 4 with a flexural moment that is substantially equal and opposite to the one generated on the doctor body 4 proper during the inking of the anilox roller 2*a* by the doctor pressure and by the pressure at which the ink is sent into the inking chamber 5.

In this manner, during the process for inking the anilox roller 2*a* the resulting flexural moment that affects the doctor body 4 is substantially nil and so is the resulting flexural deformation.

Accordingly, both contact and uniformity of the pressure of the first and second doctor blades 6*a* and 6*b* on the surface of the anilox roller 2*a* along their entire extension are ensured.

The extent to which the sleeve or sleeves 12 are screwed in can be calculated, as mentioned above, at least approximately depending on the length of the doctor body 4 and on the operating conditions of the doctor body 4, which as mentioned depend on the doctor pressure and on the pressure of the ink.

Thus, before the print test of the flexographic machine 1, the adjustment sleeves 12 are screwed onto the respective ends of the traction element or elements 10 to the calculated extent.

Depending on the printing result, the screwing of the sleeves 12 is tuned so as to achieve the best results.

Once the degree of screwing deemed optimum is reached, in order to prevent its alteration during ordinary maintenance the sleeve or sleeves 12 are locked for example by means of pins, which are not shown.

Figure 6:
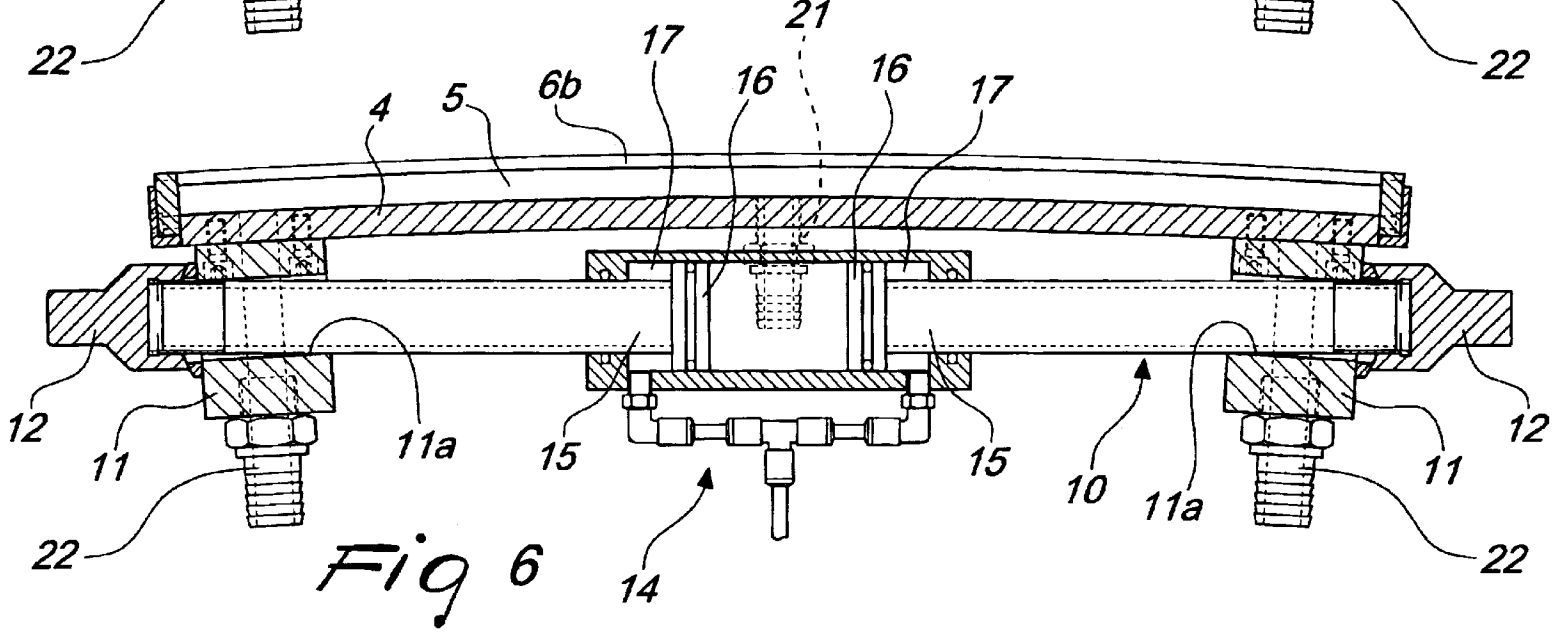
FIG. 6 is a view of the doctor body, similar to FIG. 5, with a different embodiment of the adjustment means.

With reference to FIG. 6, as an alternative, the adjustment means 9 can be constituted by fluid-operated means 14, which allow to vary the tension applied by the stiffening traction elements 10 to the respective pair of spacing supports 11 that supports them.

In this case, the stiffening traction elements 10 are composed of at least two separate portions 15, in which one end is rigidly coupled to a respective spacing support 11.

The other end of at least one of the separate portions 15 of each one of the stiffening traction elements 10 is connected to a piston element 16, which is accommodated slidingly within a chamber 17 that is connected hydraulically to a source of pressurized fluid, such as for example oil or air.

This embodiment of the adjustment means 14 therefore allows to control the traction force on the traction elements 10, varying the pressure of the fluid sent to the chamber 17.

Advantageously, the first doctor blade 6*a* and the second doctor blade 6*b* are kept in the locked position on the doctor body 4 by detachable engagement means 18.

Figure 8:
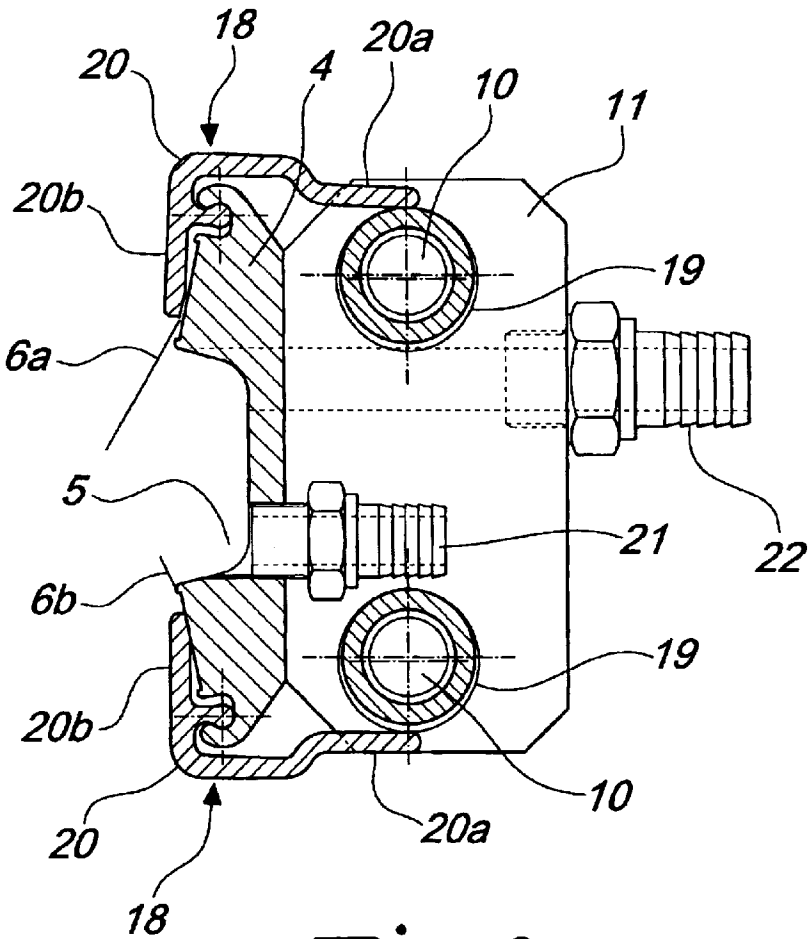
FIG. 8 is a view, similar to FIG. 7, of detachable engagement means, in the condition in which they are disengaged from a doctor blade.
Figure 7:
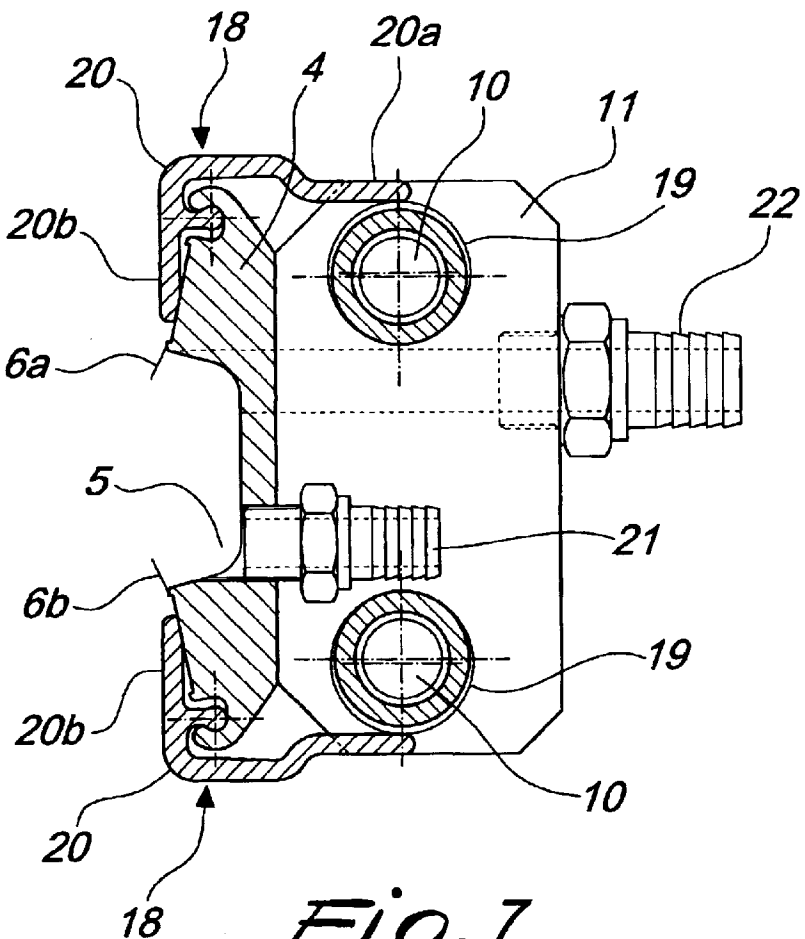
FIG. 7 is a sectional view, taken along the line VII—VII of FIG. 3.

With reference to FIGS. 7 and 8, said detachable engagement means 18 comprise eccentric means 19, which are constituted for example by a pair of eccentric cams that are pivoted coaxially substantially at the ends of a stiffening traction element 10.

As a consequence of the rotation of the eccentric means 19 about their pivoting axis, they move into engagement with an end portion 20*a* of a lever 20, which is articulated to the doctor body 4.

The other end portion 20*b* of the lever 20 acts as a blade presser, since it is designed to retain the first doctor blade 6*a* or the second doctor blade 6*b* in abutment against the doctor body 4.

The detachable engagement means 18 thus structured allow to change quickly, simply and effectively, on the machine, the first and second doctor blades 6*a* and 6*b* without the aid of specific tools on the part of the operators and without removing the doctor body 4.

The presence of the levers 20 further allows to amplify considerably the closure force applied by the end portion 20*b*.

The inking unit 2 is provided with ink feeding means, which are composed of a reservoir for containing the ink, not shown in the figures, which is connected by means of an inlet 21 to the inking chamber 5.

Discharge outlets 22 for the return of the ink to the reservoir are provided at the spacing supports 11.

Advantageously, in order to ensure the complete filling of the inking chamber 5, the discharge outlets 22 are arranged at a higher level than the inlet 21, so that the ink is conveyed upward.

In practice it has been found that the invention has achieved its intended aim and objects in all its embodiments.

In particular, it has been found that in the operating conditions of the flexographic machine 1, the inking unit 2 is capable of performing optimum inking of the anilox roller 2*a* by way of the uniform linear pressure of the first and second doctor blades 6*a* and 6*b* on the surface of said anilox roller 2*a*, with a consequent appreciable improvement in print quality.

The invention thus conceived is susceptible of numerous modifications and variations, all of which are within the scope of the appended claims.

In practice, the materials used, as well as the contingent shapes and dimensions, may be any according to requirements.

All the details may further be replaced with other technically equivalent elements.

The disclosures in Italian Patent Application No. VR2002A000088 from which this application claims priority are incorporated herein by reference.

What is claimed is:

1. A flexographic machine comprising at least one inking unit that has lateral supporting means for a doctor body that forms at least partially an inking chamber and supports at least one first doctor blade and at least one second doctor blade, said at least one inking unit comprising means for the advancement/retraction of said doctor body that are adapted to move it from a retracted position to a forward position, in which said at least one first doctor blade and said at least one second doctor blade engage an anilox roller in order to ink said anilox roller, said at least one inking unit further comprising means for feeding the ink to said inking chamber and means that contrast the inflection of said doctor body that occurs when said inking unit is in the active condition, wherein said means that contrast the inflection of said doctor body comprise means that are adapted to apply a contrasting flexural action to said doctor body, at least when said inking unit is in the active condition, said contrasting flexural action being substantially equal and opposite to the flexural action affecting said doctor body when said inking unit is in the active condition.

2. The flexographic machine according to claim 1, wherein said means adapted to apply a contrasting flexural action comprise bending means, which are adapted to bend said doctor body and adjustment means for adjusting the bending of said doctor body.

3. The flexographic machine according to claim 2, wherein said adjustment means are suitable to vary adjustably the bending of said doctor body substantially as a function of its length.

4. The flexographic machine according to claim 2, wherein said adjustment means are adapted to vary adjustably the bending of said doctor body as a function of operating conditions of said doctor body.

5. The flexographic machine according to claim 2, wherein said bending means are arranged, with respect to said doctor body, on an opposite side with respect to a side directed toward said anilox roller.

6. The flexographic machine according to claim 2, wherein said bending means comprise at least one stiffening traction element, which acts between two of spacing supports, each of which is connected mechanically to said doctor body at a respective substantially terminal portion of said doctor body.

7. The flexographic machine according to claim 6, wherein said adjustment means comprise at least one adjustment sleeve that engages by means of a screw coupling a respective end of said at least one stiffening traction element and engages by abutment, in order to subject said at least one stiffening traction element to traction, one of said two spacing supports, from which said respective end of said at least one stiffening traction element is arranged so that it protrudes.

8. The flexographic machine according to claim 6, wherein said adjustment means comprise hydraulic or pneumatic means, which are adapted to vary the tension applied by said at least one stiffening traction element to said two spacing supports, said at least one traction element comprising at least two separate portions, said hydraulic or pneumatic means having at least one piston element that can slide within a chamber that is connected hydraulically to a source of pressurized fluid, said at least one piston element being connected to a substantially terminal part of one of said at least two separate portions of said at least one stiffening traction element.

9. The flexographic machine according to claim 6, wherein said at least one stiffening traction element comprises an elongated tubular body.

10. The flexographic machine according to claim 6, further comprising detachable engagement means for keeping in the locked position at least one respective doctor blade, said means comprising eccentric means that are mounted on said at least one stiffening traction element and are adapted to engage an end portion of a lever that is articulated to said doctor body and is adapted to retain, by way of its other end portion, said at least one respective doctor blade against said doctor body.

* * * * *